United States Patent [19]

Sanno

[11] Patent Number: 4,899,532

[45] Date of Patent: Feb. 13, 1990

[54] RESIDUAL ROVING CLEARING APPARATUS

[75] Inventor: Hiroaki Sanno, Ishikawa, Japan

[73] Assignee: Murao Boki Kabushiki Kaisha, Kanazawa, Japan

[21] Appl. No.: 324,468

[22] Filed: Mar. 16, 1989

[30] Foreign Application Priority Data

Mar. 22, 1988 [JP] Japan ..... 63-67969

[51] Int. Cl.[4] ..... D01H 11/00

[52] U.S. Cl. ..... 57/304; 57/300; 57/305; 57/306; 28/292; 28/295

[58] Field of Search ..... 57/300, 303, 304, 306; 28/292–295

[56] References Cited

U.S. PATENT DOCUMENTS

| | | | |
|---|---|---|---|
| 2,014,689 | 9/1935 | McKillop | 28/292 X |
| 3,312,051 | 4/1967 | Schumann | 57/304 |
| 3,339,356 | 9/1967 | Nikel et al. | 57/303 X |
| 3,579,381 | 5/1971 | Bailey et al. | 28/292 X |
| 4,014,082 | 3/1977 | Scaglia | 28/295 |
| 4,078,282 | 3/1978 | Daalen | 28/295 |
| 4,133,168 | 1/1979 | Keller et al. | 57/304 |

FOREIGN PATENT DOCUMENTS 63-75125 4/1988 Japan .

*Primary Examiner*—Donald Watkins

*Attorney, Agent, or Firm*—Oblon, Spivak, McClelland, Maier & Neustadt

[57] ABSTRACT

A residual roving clearing apparatus for clearing a residual roving remaining on a roving bobbin. The residual roving clearing apparatus comprises a bobbin holding device for rotatably holding a roving bobbin, a cutting device for cutting layers of coils of residual roving remaining on the roving bobbin held by the bobbin holding device, and a rotary brush device for clearing the residual roving from the roving bobbin. The residual roving clearing apparatus is capable of efficiently clearing the residual roving from the roving bobbin by cutting layers of coils of the residual roving along a cutting line parallel to the axis of the roving bobbin held by the bobbin holding device, and stripping off the cut layers of coils of the residual roving from the roving bobbin by the rotary brush of the rotary brush device.

13 Claims, 5 Drawing Sheets

RESIDUAL ROVING CLEARING APPARATUS

BACKGROUND OF THE INVENTION

1. Field of the Invention

The present invention relates to a residual roving clearing apparatus for clearing up a roving bobbin of a residual roving.

2. Description of the Prior Art

A roving package is formed by winding a roving on a roving bobbin on a roving frame, the roving is exhausted on a spinning frame, and then the empty roving bobbin is returned to the roving frame. The residual roving must be cleared from the roving bobbin before returning the roving bobbin to the roving frame. The free end of a roving wound on a new roving package and a roving wound on a roving package on the creel of the spinning frame are spliced before the roving package in process is exhausted to avoid interrupting the feed of the roving. Accordingly, some roving remains on the roving bobbin removed from the creel of the spinning frame. In some cases, a large amount of roving remains on the roving bobbin when the roving packages in process are removed from the spinning frame in changing the setting of the spinning frame for spinning yarns of a different quality or when a roving package in process is removed from the spinning frame before exhaustion due to trouble in unwinding the roving from the roving package.

On the other hand, a bobbin conveying apparatus is used widely in spinning mills for saving labor. This bobbin conveying apparatus returns continuously roving bobbins removed from a spinning frame together respectively with bobbin hangers arranged in a line.

The applicant of the present patent application proposed a residual roving clearing apparatus intended for use in combination with such a bobbin conveying apparatus in Japanese Patent Laid-open (Kokai) No. 63-75125. This previously proposed residual roving clearing apparatus transfers roving bobbins being conveyed on bobbin hangers to a device and clears residual rovings efficiently from the roving bobbins by pressing a running bristled belt against the roving bobbins to rotate the roving bobbins, to find the free ends of rovings wound on the roving bobbins and to unwind the residual rovings from the roving bobbins.

This residual roving clearing apparatus, however, operates at a very low efficiency and takes an excessively long time to clear the residual roving from the roving bobbin when a large amount of roving remains on the roving bobbin, because many layers of coils of the residual roving must be removed sequentially from the outermost layer to the innermost layer.

DISCLOSURE OF THE INVENTION

Accordingly, it is a principal object of the present invention to provide a residual roving clearing apparatus capable of efficiently clearing residual rovings remaining on roving bobbins in a comparatively short time.

In order that the residual roving clearing apparatus of the present invention can be used in combination with a roving bobbin conveying apparatus, the residual roving clearing apparatus is so designed as to clear residual rovings from roving bobbins suspended on bobbin hangers and to function without adversely affecting the conveying speed of the roving bobbin conveying apparatus and without causing the roving bobbins to fall off the bobbin hangers.

BRIEF DESCRIPTION OF THE DRAWINGS

FIGS. 1 through 6 are illustrations of a residual roving clearing apparatus in a preferred embodiment according to the present invention, in which FIG. 1 is an enlarged perspective view of an essential portion of the residual roving clearing apparatus;

FIG. 2 is a partly cutaway side elevation of the residual roving clearing apparatus;

FIG. 3 is a general plan view of the residual roving clearing apparatus;

FIG. 4 is an enlarged fragmentary side elevation showing an essential portion of the residual roving clearing apparatus shown in FIG. 2;

FIG. 5 is an enlarged fragmentary sectional side elevation of an essential portion of the residual roving clearing apparatus shown in FIG. 2;

FIG. 6 is a sectional view taken on line VI—VI in FIG. 2; and

$BH_0$ . . . Bobbin hanger $F_1$ . . . Frame $PS_1$ . . . Photoelectric switch PSa . . . Optical axis

DETAILED DESCRIPTION OF THE PREFERRED EMBODIMENT

Figure 1:
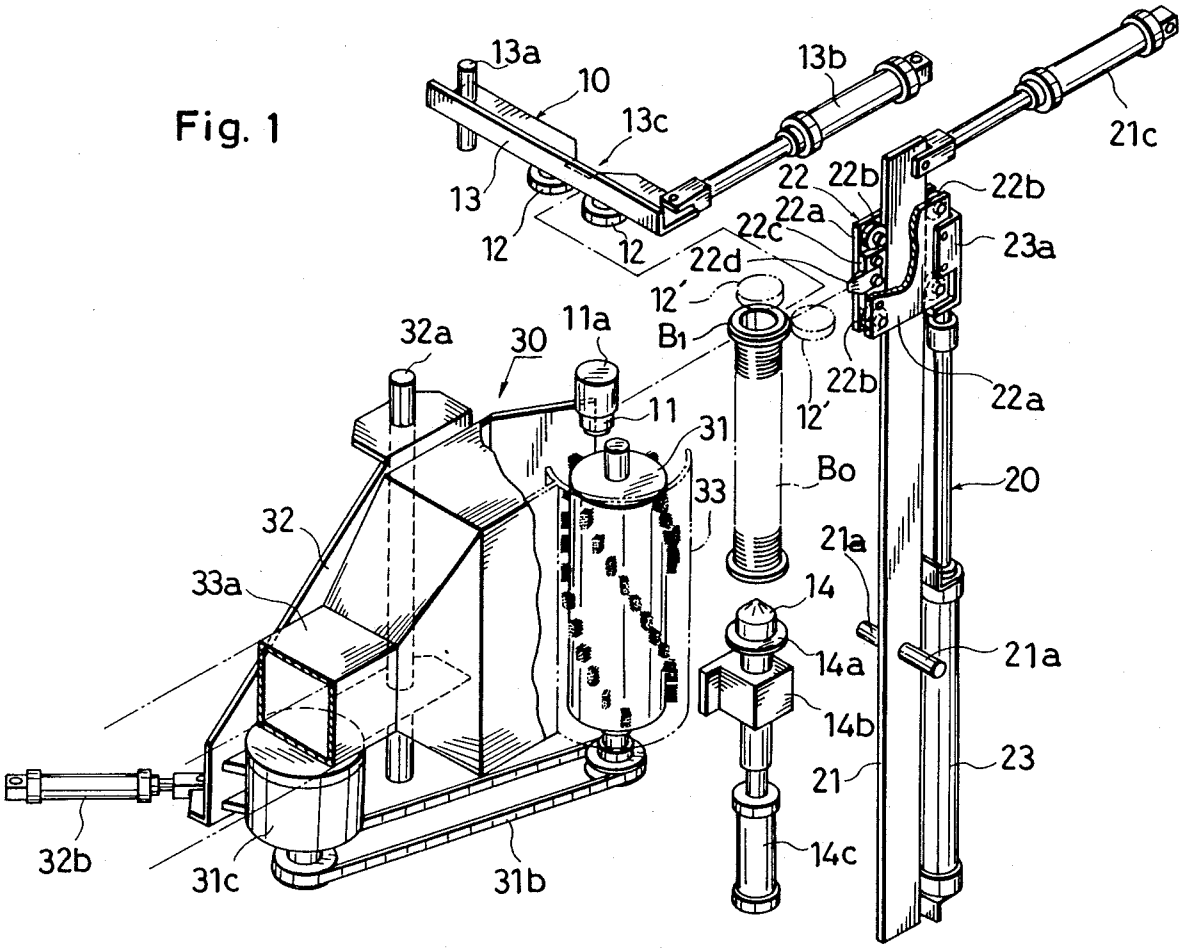
Figure 2:
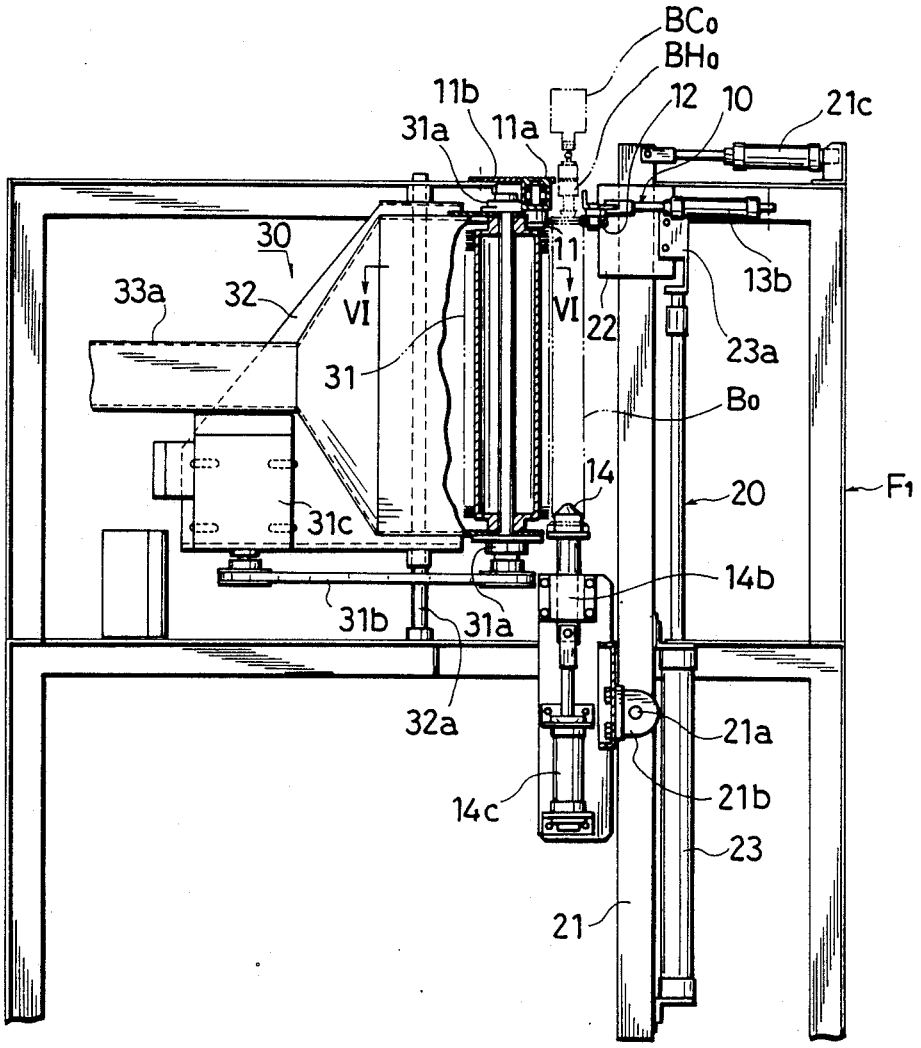
Figure 3:
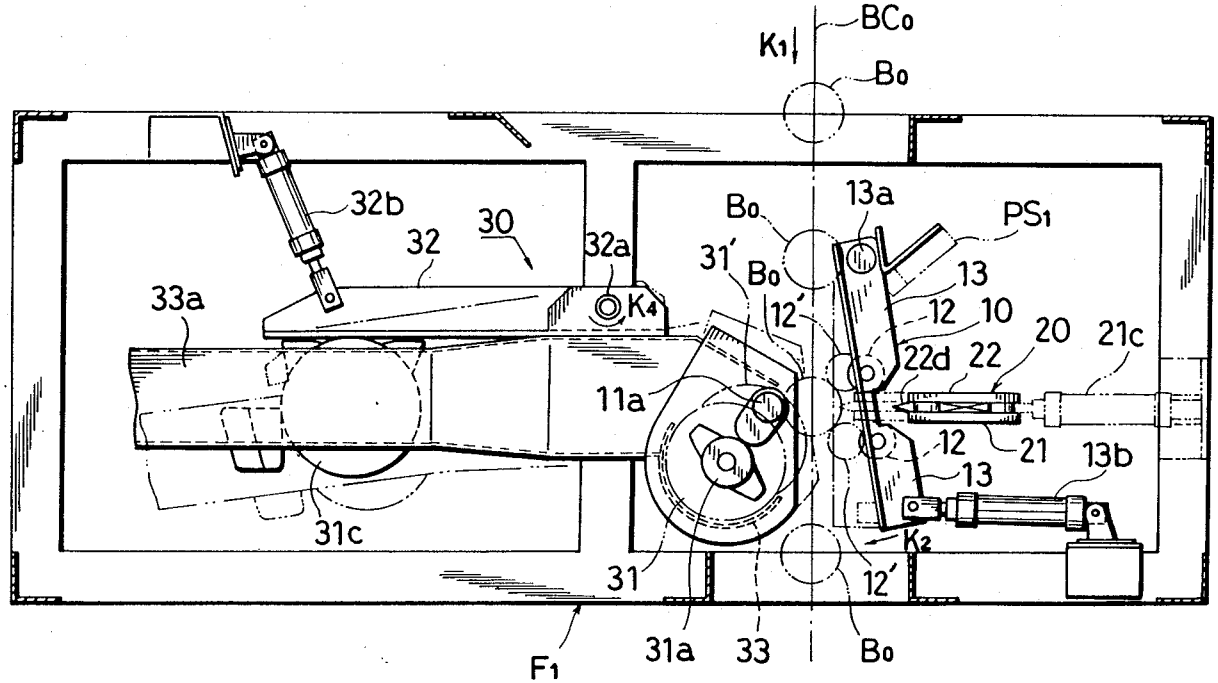

Referring to FIG. 1, a residual roving clearing apparatus (hereinafter, referred to simply as "clearing apparatus") embodying the present invention comprises, as principal components, a bobbin holding device 10, a cutting device 20 and a rotary brush device 30, which are assembled integrally on a frame $F_1$ as shown in FIGS. 2 and 3.

Roving bobbins $B_0$ carrying residual rovings are suspended on bobbin hangers $BH_0$, respectively, for continuous conveyance by a bobbin conveying apparatus $BC_0$. The clearing apparatus clears the residual rovings from the roving bobbins $B_0$ without removing the roving bobbins $B_0$ from the bobbin hangers $BH_0$.

Figure 6:
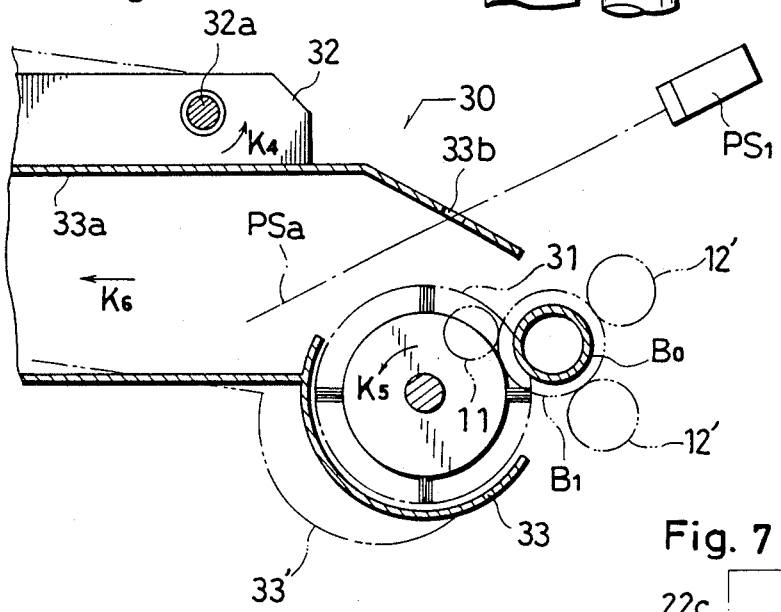

The bobbin holding device 10 has a stationary roller 11 supported for rotation at a fixed position, and movable rollers 12 capable of being moved toward and away from a roving bobbin $B_0$ (FIGS. 1, 2 and 3). The stationary roller 11 is supported rotatably on bearings contained in a bearing housing 11*a*, which in turn is held fixedly on the upper beam of the frame $F_1$ by a bracket 11*b* so that the stationary roller 11 depends from the bearing housing 11*a*. The movable rollers 12 are journaled on a swing arm 13 so as to depend from the swing arm 13. The swing arm 13 has one end pivotally supported with a pin 13*a* on the frame $F_1$ and the other end pivotally joined to the free end of the piston rod of a pneumatic actuator 13*b* mounted on the frame $F_1$. A recess 13*c* is formed in the swing arm 13 at a position in the middle between the movable rollers 12. As best shown in FIGS. 3 and 6, a photoelectric switch $PS_1$, which will be described afterward, is attached to the swing arm 13 to detect the completion of clearing the roving bobbin $B_0$. The stationary roller 11 and the two movable rollers 12 may be substituted by two stationary rollers and a single movable roller.

The bobbin holding device 10 has a rotary bobbin holder 14 disposed so as to be detachably inserted in the lower bore of the roving bobbin $B_0$ suspended in a vertical position. The rotary bobbin holder 14 has a conical head provided with a flange 14a and supported rotatably on bearings on a sliding shaft vertically slidably guided by a slide guide 14b fixed to the frame $F_1$. The lower end of the sliding shaft of the rotary bobbin holder 14 is connected to the piston rod of a pneumatic actuator 14c attached to the frame $F_1$.

The cutting device 20 has a guide rail 21 and a cutting head 22. The guide rail 21 is an elongate plate member provided with a pin 21a projecting in opposite directions substantially from the middle of the major sides of the guide rail 21, respectively. The guide rail 21 is supported swingably by the pin 21a on a bracket 21b fixed to the frame $F_1$ so that the guide rail 21 can be extended in parallel to the axis of the roving bobbin $B_0$. The guide rail 21 is connected pivotally at the upper end thereof to the free end of the piston rod of a pneumatic actuator 21c connected to the frame $F_1$.

Figure 4:
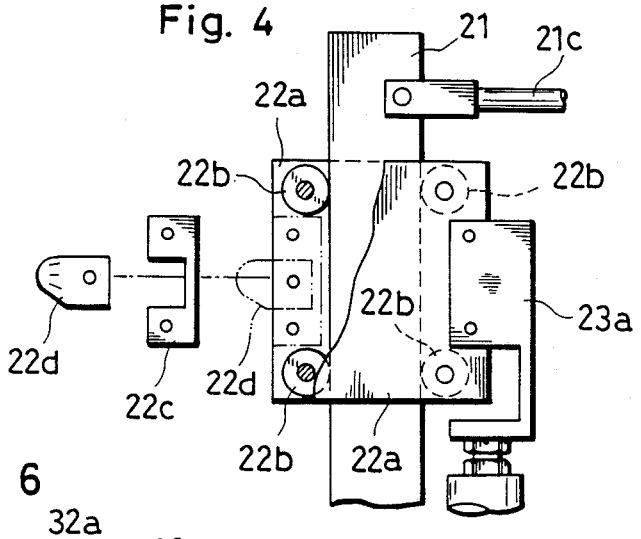

As shown in FIG. 4, the cutting head 22 comprises two side plates 22a disposed on the opposite sides of the guide rail 21, guide rollers 22b in rolling contact respectively with the front and rear minor sides of the guide rail 21, and a blade 22d held on the side plates 22a by a bracket 22c. The blade 22d projects to the front from the cutting head 22 so that the cutting edge thereof is positioned in near contact with the circumference of the roving bobbin $B_0$ when the guide rail 21 is extended in parallel to the axis of the roving bobbin $B_0$.

As shown in FIGS. 1 and 2, the cylinder of a pneumatic actuator 23 is fixed to the rear minor side of the guide rail 21 with its axis extending along the longitudinal direction of the guide rail 21. The free end of the piston rod of the pneumatic actuator 23 is connected to a bracket 23a fixed to the cutting head 22.

The rotary brush device 30 has a rotary brush 31 as a principal component. The shaft of the rotary brush 31 is supported in a vertical position at the upper and lower ends thereof in bearings 31a on a bracket 32 (FIGS. 1, 2 and 3). A belt 31b is extended between a pulley attached to the lower end of the shaft of the rotary brush 31 and a pulley attached to the output shaft of a motor 31c. The rotary brush 31 and the motor 31c are mounted on the bracket 32. The bracket 32 is supported for turning motion on a shaft 32a attached to the frame $F_1$. One end of the bracket 32 remote from the rotary brush 31 is connected to the free end of the piston rod of a pneumatic actuator 32b. The rotary brush 31 is driven for rotation by the motor 31c and can be brought into contact with the circumference of the roving bobbin $B_0$ by the pneumatic actuator 32b.

As shown in FIG. 6, the circumference of the rotary brush 31 is covered partly with a cover plate 33 attached to the extremity of a suction duct 33a connected to a suction device, not shown.

In operation, the piston rod of the pneumatic actuator 14c is retracted to hold the rotary holder 14 at a lower position, the piston rod of the pneumatic actuator 13b is retracted to retract the movable rollers 12, the piston rod of the pneumatic actuator 21c is retracted to tilt the guide rail backward, the piston rod of the pneumatic actuator 32b is retracted to hold the rotary brush 31 at a standby position and the piston rod of the pneumatic actuator 23 is projected to position the cutting head 22 at an uppermost position to set the clearing apparatus for standby state.

Then, the bobbin conveying apparatus is actuated to convey roving bobbins $B_0$ carrying residual rovings by one pitch of a successive arrangement of the roving bobbins $b_0$ in the direction of an arrow $K_1$ (FIG. 3) to locate one of the roving bobbins $b_0$ at a position in front of the cutting device 20 and directly above the rotary bobbin holder 14.

Then, the piston rod of the pneumatic actuator 14c is projected to raise the rotary bobbin holder 14 as far as the conical head of the rotary bobbin holder 14 is fitted in the lower end of the bore of the roving bobbin $B_0$. Then, the piston rod of the pneumatic actuator 13b is projected to turn the swing arm 13 to the front, namely, in the direction of an arrow $K_2$ (FIG. 3) so that the rotary rollers 12 are moved toward the roving bobbin $B_0$ to positions indicated at 12' to locate the roving bobbin $B_0$ by holding the upper ring $B_1$ of the roving bobbin $B_0$ between the movable rollers 12 and the stationary roller 11 as indicated by long and two short dashes lines in FIG. 3. Consequently, the roving bobbin $B_0$ is held rotatably by the rotary bobbin holder 14, the movable rollers 12 and the stationary roller 11. In this state, the roving bobbin $B_0$ is on the conveying path of the bobbin conveying apparatus $BC_0$ and is suspended on the bobbin hanger $BH_0$, and hence the orientation and position relative to the bobbin hanger $BH_0$ of the roving bobbin $B_0$ remain unchanged.

Figure 5:
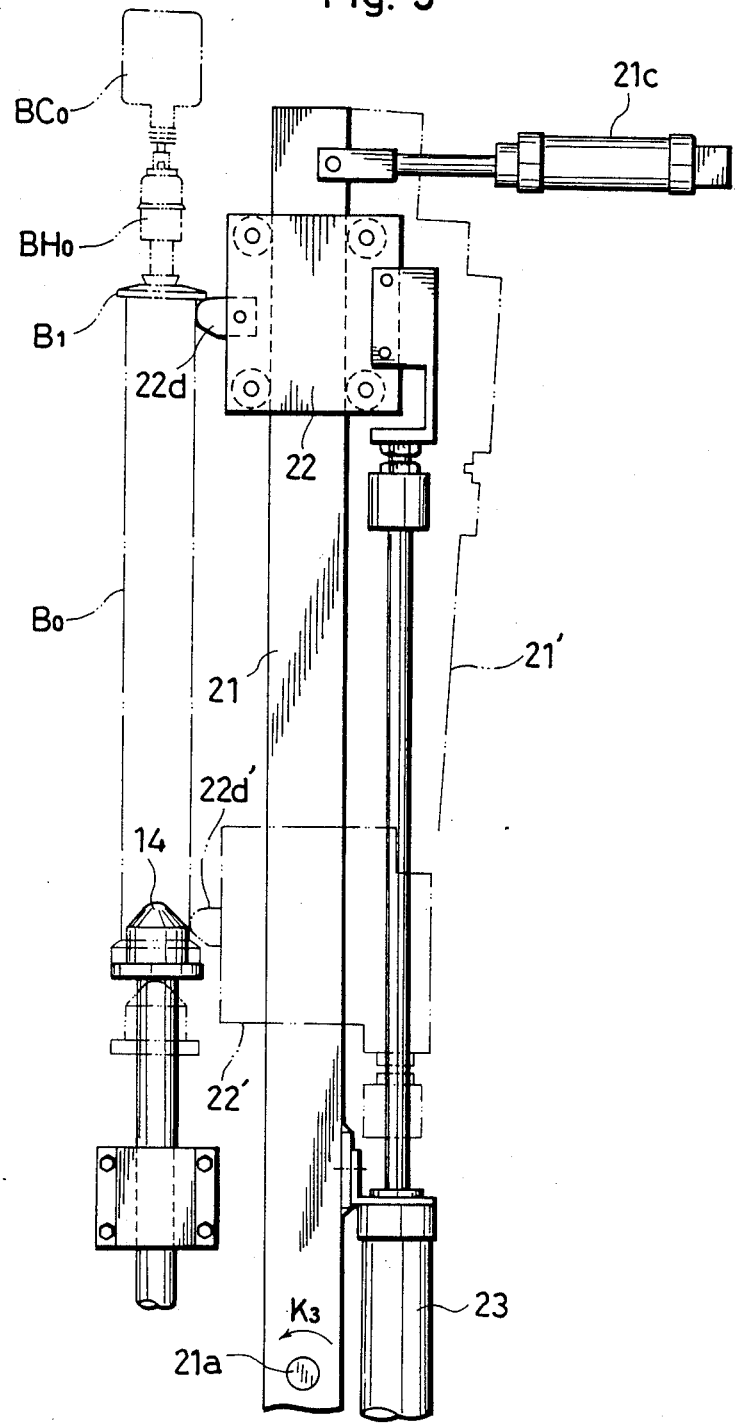

Then, the piston rod of the pneumatic actuator 21c is projected to turn the guide rail 21 on the pin 21a in the direction of an arrow $K_3$ (FIG. 5) so that the guide rail 21 stands upright in parallel to the axis of the roving bobbin $B_0$ as indicated by solid lines in FIG. 5. In this state, the cutting edge of the blade 22d of the cutting head 22 is brought into near contact with the circumference of the roving bobbin $B_0$. Then, the piston rod of the pneumatic actuator 23 is retracted to move the cutting head 22 downward along the guide rail 21 to a lowermost position 22' as indicated by alternate long and two short dashes lines in FIG. 5, whereby the layers of coils of the roving remaining on the roving bobbin $B_0$ are cut with the blade 22d along a cutting line parallel to the axis of the roving bobbin $B_0$. The stroke of the piston rod of the pneumatic actuator 23 is decided so that the cutting edge of the blade 22d is positioned opposite a position immediately below the ring $B_1$ of the roving bobbin $B_0$ when the cutting head 22 is at the uppermost position and positioned opposite the lower end of the roving bobbin $B_0$ when the cutting head 22 is at the lowermost position.

Then, the piston rod of the pneumatic actuator 21c is retracted to tilt the guide rail 21 backward to a position indicated by alternate long and two short dashes lines in FIG. 5 to retract the blade 22d from the working position, and then the piston rod of the pneumatic actuator 32b is projected to turn the bracket 32 mounted with the rotary brush 31 and the associated components on the shaft 32a in the direction of an arrow $K_4$ (FIGS. 3 and 6) so that the rotary brush 31 is pressed against the roving bobbin $B_0$ as indicated by solid lines in FIG. 6. At the same time, the motor 31c is actuated to rotate the rotary brush 31 in the direction of an arrow $K_5$ (FIG. 6) in contact with the roving bobbin $B_0$, whereby the residual roving is removed continuously from the roving bobbin $B_0$ by the rotary brush 31. Since the coils of the residual roving have been cut previously with the blade 22d of the cutting device 20 and the roving bobbin $B_0$ is rotated forcibly by the rotary brush 31, the residual roving can be cleared efficiently from the roving bobbin $B_0$ in a very short time even if the quantity of the residual roving is large. Even if the coils of the residual roving in the bottom layer are not cut with the blade 22*d*, those coils of the residual roving can be removed in a short time with the bristles of the rotary brush 31.

The residual roving thus cleared from the roving bobbin $B_0$ is sucked through the cover plate 33 and the suction duct 33*a* by the suction device, not shown, in the direction of an arrow $K_6$ (FIG. 6) and is accumulated as waste in a waste collecting device, not shown.

While the residual roving is being cleared from the roving bobbin $B_0$, the residual roving passes across a light beam PSa projected by the photoelectric switch $PS_1$, and thereby the photoelectric switch $PS_1$ is able to detect the residual roving passing through the suction duct 33*a*. Upon the completion of clearing the residual roving from the roving bobbin $B_0$, no roving passes across the light beam PSa, and thereby the photoelectric switch $PS_1$ detects the complete removal of the residual roving from the roving bobbin $B_0$. Upon the detection of completion of clearing the residual roving from the roving bobbin $B_0$, the motor 31*c* is stopped, the piston rod of the pneumatic actuator 32*b* is retracted to separate the rotary brush 31 from the roving bobbin $B_0$, the piston rod of the pneumatic actuator 13*b* retracted to retract the movable rollers 12 and the piston rod of the pneumatic actuator 14*c* is retracted to lower the rotary bobbin holder 14 to release the roving bobbin $B_0$.

Since the photoelectric switch $PS_1$ stops the motor 31*c* upon the indirect detection of completion of clearing the residual roving from the roving bobbin $B_0$, the photoelectric switch $PS_1$ may be replaced with a switch with a timer for operating the motor 31*c* for a predetermined period of time for each residual roving clearing cycle.

After the roving bobbin $B_0$ has been thus released, the bobbin conveying apparatus $BC_0$ is actuated to advance the successive roving bobbins $B_0$ by one pitch to position the next roving bobbin $B_0$ at the residual roving clearing position, and then the residual roving clearing cycle is repeated. The cutting head 11 is returned to the uppermost position while the guide rail 21 is tilted backward to retract the blade 22*d* from the cutting position.

Pressure for pressing the rotary brush 31 against the surface of the roving package, namely, the surface layer of the residual rovings on the roving bobbin $B_0$, can be adjusted to an optional value by adjusting the pressure of air supplied to the pneumatic actuator 32*b*, and the rotary brush 31 can be pressed against the surface of the roving package regardless of the variation of the diameter of the roving package resulting from the gradual removal of the layers of coils of the residual roving.

Figure 7:
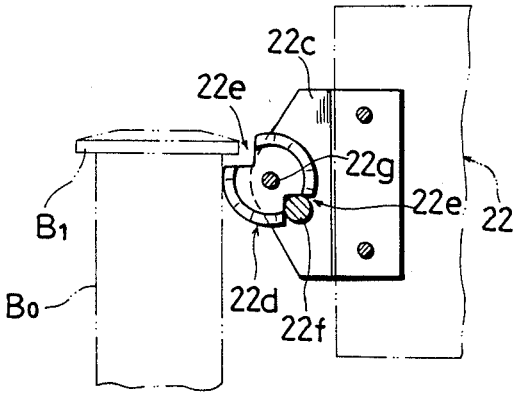
FIG. 7 is a side elevation of a modification of a cutter assembly employed in the residual roving clearing apparatus.

The blade 22*d* of the cutting head 22 may be a circular blade provided with a pair of recesses 22*e* formed at diametrically opposite positions, respectively, as shown in FIG. 7. This circular blade 22*d* is fixed with a screw 22*g* to the bracket 22*c* and is retained in place with a fixed pin 22*f* so that one of the recess 22*e* is positioned opposite to the ring $B_1$ of the roving bobbin $B_0$ when the cutting head 22 is at the uppermost position and the guide rail 21 is positioned in parallel to the axis of the roving bobbin $B_0$. Thus, the circular blade 22*d* is able to cut all the coils of the residual roving immediately below the ring $B_1$, and the life of the blade 22*d* can be doubled by changing the angular position of the blade 22*d*.

In the operation of the clearing apparatus described, the roving bobbins $B_0$ are conveyed on the bobbin hangers $BH_0$ by the bobbin conveying apparatus $BC_0$, and each roving bobbin $B_0$ is held as suspended on the bobbin hanger $BH_0$ by the bobbin holding device 10 for residual roving clearing. However, the roving bobbin $B_0$ may be removed automatically or manually from the bobbin hanger $BH_0$, and then the individual roving bobbin $B_0$ may be held by the bobbin holding device 10 for residual roving clearing. Accordingly, the clearing apparatus of the present invention is applicable to clearing the residual roving even if the bobbin hanger $BH_0$ is unable to rotate.

A residual roving clearing apparatus may comprise a plurality of units each comprising the bobbin holding device 10, the cutting device 20 and the rotary brush device 30, and arranged side by side at intervals corresponding to the pitches of the roving bobbins $B_0$ on the bobbin conveying apparatus $BC_0$, and may simultaneously clear a plurality of roving bobbins $B_0$ of the residual rovings. Such a construction of the residual roving clearing apparatus further reduces virtual clearing time per roving bobbin.

As is apparent from the foregoing description, according to the present invention, layers of coils of roving remaining on a roving bobbin rotatably held by a bobbin holding device are cut longitudinally of the roving bobbin by a cutting device, and then the layers of coils of roving are removed continuously by a rotary brush, which reduces residual roving clearing time remarkably. Furthermore, a residual roving clearing apparatus of the present invention can be included in a bobbin conveying line using a bobbin conveying apparatus to clear residual rovings efficiently from roving bobbins being conveyed along the bobbin conveying line without interfering with the bobbin conveying operation of the bobbin conveying apparatus.

What is claimed is:

1. A residual roving clearing apparatus for clearing a roving remaining on a roving bobbin, comprising:

a bobbin holding device for rotatably holding a roving bobbin;

a cutting device for cutting layers of coils of roving remaining on a roving bobbin by setting a blade with its cutting edge in near contact with the circumference of the roving bobbin and moving the blade in parallel to the axis of the roving bobbin; and a rotary brush device including a rotary brush which is rotated and held in contact with the surface of the layers of coils of rovings on the roving bobbin to clear the layers of coils of roving cut by the cutting device from the roving bobbin.

2. A residual roving clearing apparatus according to claim 1, wherein said cutting device comprises: a guide rail disposed longitudinally of the roving bobbin held by the bobbin holding device so as to be moved toward and to be moved away from the roving bobbin; and a cutting head capable of moving along the guide rail.

3. A residual roving clearing apparatus according to claim 1, wherein said bobbin holding device comprises: a rotary holder having a holding head capable of being removably fitted in the lower end of the bore of a roving bobbin delivered to the bobbin holding device in a vertical position; and three rotating rollers capable of rotating in contact with a top ring attached to the upper end of the roving bobbin.

4. A residual roving clearing apparatus according to claim 1, wherein said rotary brush device has a cover plate covering a portion of the circumference of said rotary brush, and a duct extending from the cover plate and connected to a suction device, and said rotary brush can be brought into contact with the surface of layers of coils of roving on a roving bobbin held by said bobbin holding device and moved away from the roving bobbin.

5. A residual roving clearing apparatus according to claim 1, wherein said bobbin holding device is disposed on a conveying path along which a bobbin conveying apparatus conveys roving bobbins.

6. A residual roving clearing apparatus according to claim 1, wherein said bobbin holding device has a switch capable of detecting a residual roving remaining on a roving bobbin, and said bobbin holding device decides whether or not cut layers of coils of roving remain on the roving bobbin through the detection of the position of said rotary brush by the switch.

7. A residual roving clearing apparatus according to claim 2, wherein said cutting head comprises: a blade holding member, guide rollers supported rotatably on the blade holding member for rolling along the guide rail, and a blade attached to the blade holding member; and the cutting head is moved along the guide rail by a pneumatic actuator.

8. A residual roving clearing apparatus according to claim 3, wherein one of the three rotating rollers of said bobbin holding device is a stationary rotating roller, and the rest of the rotating rollers are movable rollers capable of being brought into contact with and being separated from the top ring of a roving bobbin.

9. A residual roving removing apparatus according to claim 2, wherein said cutting device is supported pivotally on a pin for swing motion on a frame member.

10. A residual roving clearing apparatus according to claim 3, wherein said rotary bobbin holder is supported axially slidably on a frame member so as to be driven for axial sliding movement by a pneumatic actuator, said movable rotating rollers are supported rotatably on a swing arm pivotally supported for swing motion on a frame member, and the swing arm is driven for swing motion by a pneumatic actuator.

11. A residual roving clearing apparatus according to claim 4, wherein said rotary brush is driven for rotation through a belt by an electric motor, said rotary brush and the electric motor are mounted on a swing bracket supported for swing motion by a shaft on a frame member, and the swing bracket is driven for swing motion by a pneumatic actuator.

12. A residual roving clearing apparatus according to claim 6, wherein said switch for detecting a residual roving remaining on a roving bobbin is connected electrically to said electric motor for driving said rotary brush for the on-off control of said electric motor.

13. A residual roving clearing apparatus according to claim 1, wherein a plurality of units each of said bobbin holding device, said cutting device and said rotary brush device are arranged side by side along a conveying path along which a bobbin conveying apparatus conveys roving bobbins.

* * * * *